US012800148B2

(12) United States Patent
Harmeling et al.

(10) Patent No.: US 12,800,148 B2
(45) Date of Patent: Nov. 17, 2026

(54) HEAT DEFLECTOR

(71) Applicant: Lamplight Farms Incorporated, Menomonee Falls, WI (US)

(72) Inventors: Andrew Alan Harmeling, Milwaukee, WI (US); Andrew Schauer, Waukesha, WI (US); Daniel J. Knight, Murfreesboro, TN (US); Kyle Ressler, West Bend, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 336 days.

(21) Appl. No.: 18/545,063

(22) Filed: Dec. 19, 2023

(65) Prior Publication Data

US 2024/0219030 A1 Jul. 4, 2024

Related U.S. Application Data

(60) Provisional application No. 63/435,604, filed on Dec. 28, 2022.

(51) Int. Cl.
*F24B 1/195* (2006.01)

(52) U.S. Cl.
CPC ..... *F24B 1/1957* (2013.01)

(58) Field of Classification Search
CPC ..... F24B 1/1957
USPC ..... 126/552
See application file for complete search history.

(56) References Cited

U.S. PATENT DOCUMENTS

| | | | | |
|---|---|---|---|---|
| 4,909,235 | A * | 3/1990 | Boetcker | A47J 37/0704 126/25 C |
| 5,797,386 | A * | 8/1998 | Orr | A47J 37/0763 126/25 R |
| 2022/0170637 | A1* | 6/2022 | Ressler | F24B 1/192 |
| 2023/0151967 | A1* | 5/2023 | Weilert | F24B 1/1957 126/59 |

* cited by examiner

*Primary Examiner* — Avinash A Savani
(74) *Attorney, Agent, or Firm* — McAfee & Taft; David G. Woodral

(57) ABSTRACT

A fire pit having a deflector ring that is received in a fire screen located on the top of the fire pit. The deflector ring has wall portions that are angled from 45 to 75 degrees for deflecting heat onto the feet, body, and head of users surrounding the fire pit, reducing smoke production, and for minimizing flame obstruction. The fire pit includes a pit body having a wall section and a top surface that defines a fire pit receptacle opening. A lower screen is located above the top surface. An upper screen is located above the lower screen. A frustum-shaped deflector is received in the lower screen. An outer surface of a wall portion of the deflector is for radiating heat onto a user's body and feet, and an inner surface of the wall portion of the deflector is for radiating heat onto a user's body and head.

11 Claims, 12 Drawing Sheets

HEAT DEFLECTOR

CROSS-REFERENCE TO RELATED CASES

This application claims the benefit of U.S. provisional patent application Ser. No. 63/435,604, filed on Dec. 28, 2022, and incorporates such provisional application by reference into this disclosure as if fully set out at this point.

FIELD OF THE INVENTION

The invention relates to outdoor fire pits in general and, more specifically, to a heat deflector for use with an outdoor fire pit.

BACKGROUND OF THE INVENTION

Outdoor fire pits have become popular and desirable for containing outdoor fires. Fire pits may provide for more controlled and/or extended burning of fuels versus a completely open fire. Fire pits may rely on natural wood, engineered wood logs, pelletized fuel packs, or other fuels.

Fire pits may elevate the fire and at least some of the heat away from the ground surface. They may provide ash handling features. A fire pit may comprise an outer wall and possibly a double wall. The outer wall or double wall may also control air flow to the fire to improve flame appearance and/or reduce smoke.

Many fire pits have an upper opening through which flames appear and which allows gaseous combustion products to escape. However, in some cases, the presence of the outer wall or double wall can reduce the radiant heat felt from the fire. For some users, having at least some radiant heat is an enjoyable aspect of the outdoor fire experience.

What is needed is a device and method for addressing the above and related concerns.

SUMMARY OF THE INVENTION

The invention relates to a reflector ring that fits down into a fire screen that is received on the top of a fire pit. The ring is an inverted frustrum. The wall angle appears to be critical both for obtaining adequate radiative heat deflection and for minimizing flame and smoke ejection. It is estimated that an angle in the range of 45-75 degrees is most effective for deflecting heat onto the feet, body, and head of users surrounding the fire pit, reducing smoke production, and for minimizing flame obstruction. In one embodiment, the frustum shaped ring is a portion of a cone for being received in a circular fire pit. In another embodiment, the frustum is a portion of a four-sided pyramid for being received in a rectilinear fire pit.

In greater detail the invention relates to a fire pit having a pit body with a wall section and a top surface adjacent to an upper end of the wall section, wherein the top surface defines a fire pit receptacle opening.

A lower screen is located above the top surface. An upper screen is located above the lower screen.

A deflector is received in the lower screen. The deflector has a frustum shape. An outer surface of a wall portion of the deflector is for radiating heat onto a user's body and feet, and an inner surface of the wall portion of the deflector is for radiating heat onto a user's body and head.

A support ring may be provided on the top surface surrounding the fire pit receptacle opening. A bottom screen surface of the lower screen may be received adjacent to the support ring on the top surface.

An upper screen ring may be supported by a top screen surface of the lower screen, wherein the upper screen ring defines an outer annular step and an inner upper support surface. A lower screen surface of the upper screen may communicate with the upper screen ring, wherein the lower screen surface of the upper screen is sized for being received on the outer annular step of the upper screen ring. A handle may be provided on the upper screen ring.

In one embodiment, an upper end of the wall portion of the deflector defines an outwardly extending lip that is sized for being received on the inner support surface of the upper screen ring.

In one embodiment, the wall portion of the deflector defines a through hole for facilitating installation and removal of the deflector with an implement without requiring a user to touch the deflector.

Preferably, a circumference of the lower end of the deflector is smaller than a circumference of the upper end such that the wall portion is offset from vertical to have an outward lean, wherein the wall portion of the deflector is 45 to 75 degrees, 73.6 to 74.8 degrees or approximately 74.5 degrees from vertical.

The pit body, the lower screen and the deflector have a circular cross-section, a rectangular cross-section or a have a cross-section of another shape.

In one embodiment, an upper end of the deflector defines a cut-out and the upper screen includes a downwardly extending hook for locating in the cut-out for allowing the upper screen to be hung off to a side of the pit body for stoking or for fueling the pit body.

DETAILED DESCRIPTION OF THE PREFERRED EMBODIMENTS

Figure 1:
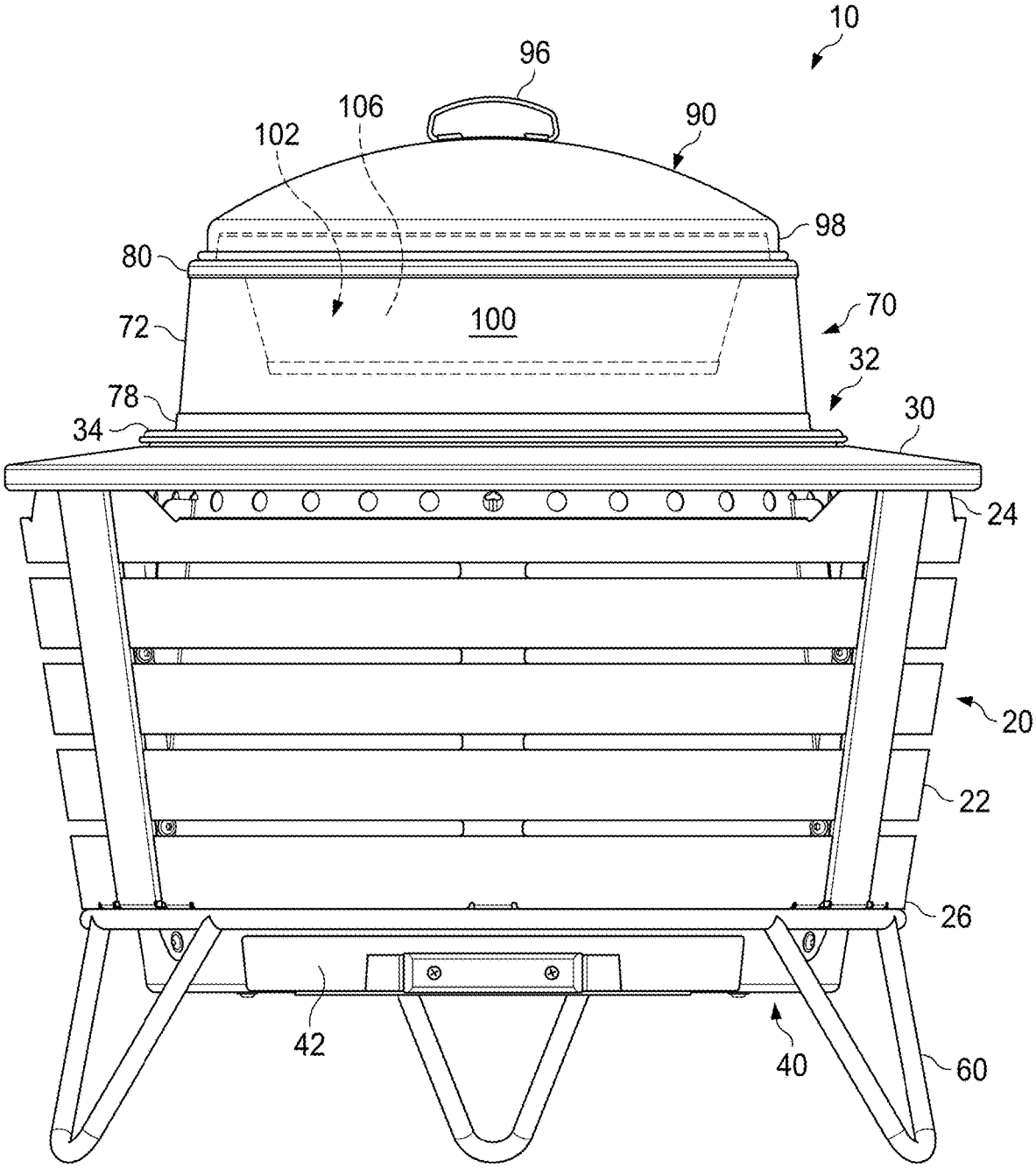
FIG. 1 is an elevation view of a fire pit of the invention.

Outdoor fire pits have become popular and desirable for containing outdoor fires. Fire pits may provide for more controlled and/or extended burning of fuels versus a completely open fire. Fire pits may rely on natural wood, engineered wood logs, pelletized fuel packs, or other fuels.

Fire pits may elevate the fire and at least some of the heat away from the ground surface. They may provide ash handling features. A fire pit may comprise an outer wall and possibly a double wall. The outer wall or double wall may also control air flow to the fire to improve flame appearance and/or reduce smoke.

Many fire pits have an upper opening through which flames appear and which allows gaseous combustion products to escape. However, in some cases, the presence of the outer wall or double wall can reduce the radiant heat felt from the fire. For some users, having at least some radiant heat is an enjoyable aspect of the outdoor fire experience.

Referring now to the Figures, shown is a fire pit designated generally 10. Fire pit 10 includes fire pit body 20 having wall section 22. Wall section 22 has upper end 24 and lower end 26. Top surface 30 is adjacent to upper end 24 of wall section 22. Top surface 30 defines fire pit receptacle opening 32 surrounded by support ring 34.

Bottom surface 40 is adjacent to lower end 26 of wall section 22. In one embodiment, bottom surface 40 defines ash pan 42.

Fire grate 50 may be provided about ash pan 42 as a component of an internal fire or combustion engine of fire pit 10.

A plurality of supports or legs 60 elevate bottom surface 40 off of a ground surface.

Figure 4:
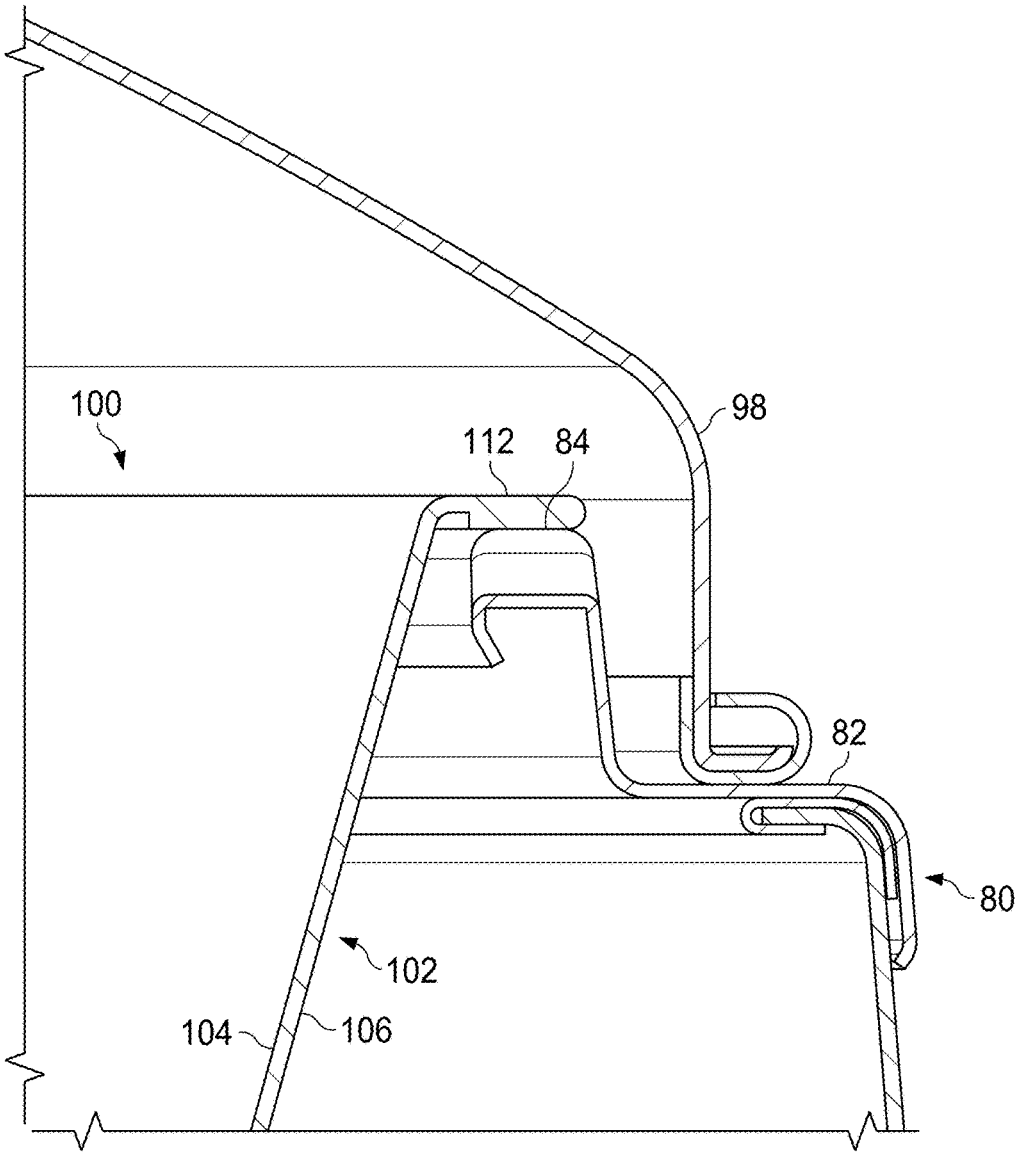
FIG. 4 is an enlarged elevation view of the upper screen, the lower screen and the deflector of the fire pit of FIG. 1.
Figure 5:
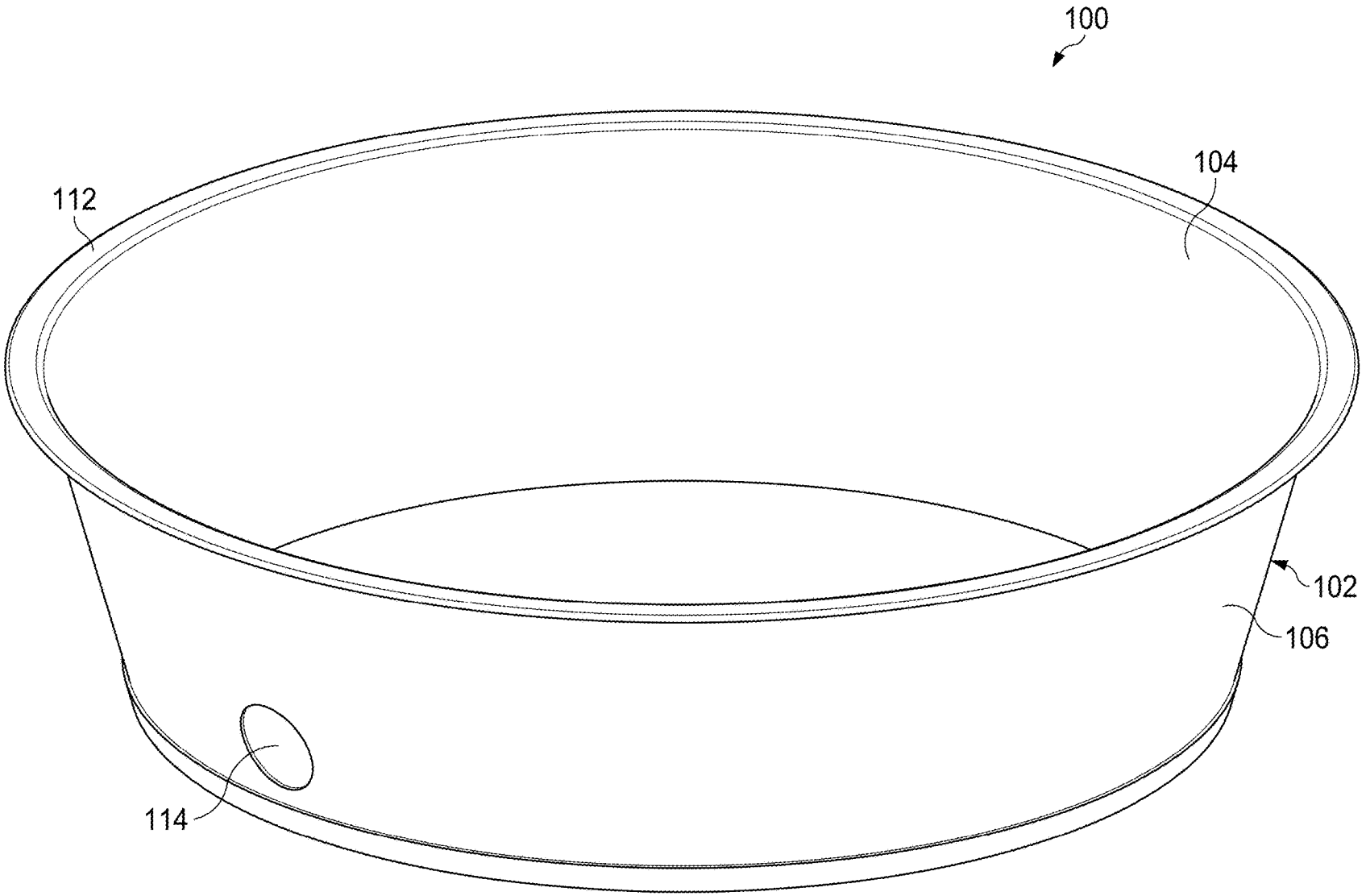
FIG. 5 is a perspective view of the deflector of the fire pit of FIG. 1.
Figure 6B:
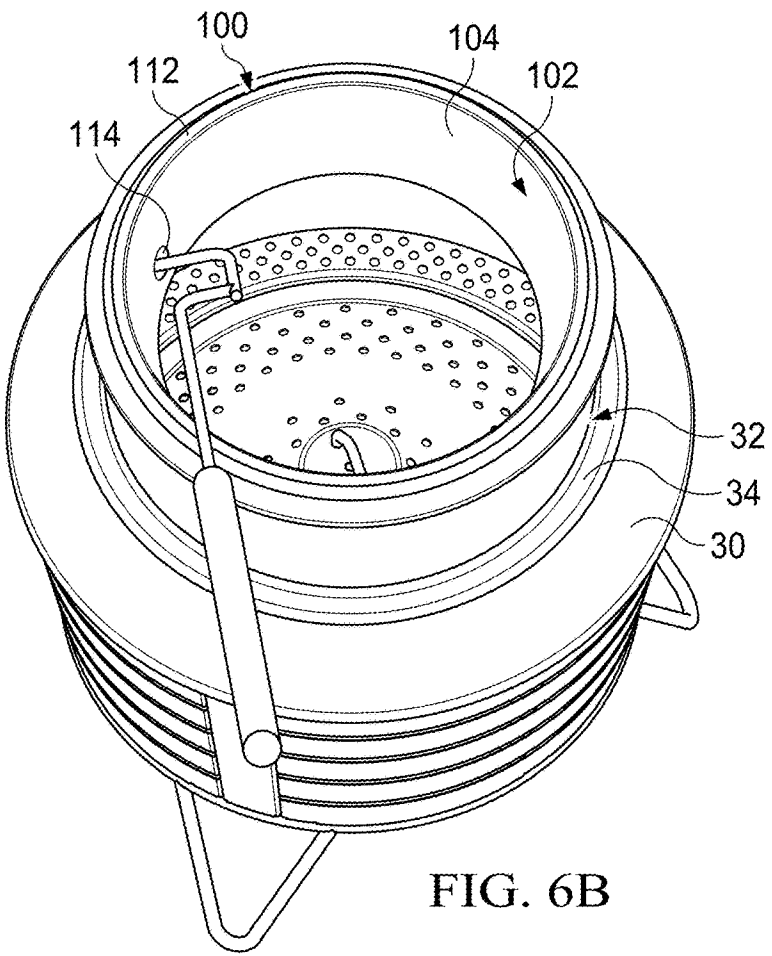
FIG. 6B is a photographic perspective view of the deflector located in the fire pit of FIG. 6A with the upper screen removed and showing an implement inserted into a through hole for facilitating removal of the deflector.
Figure 6A:
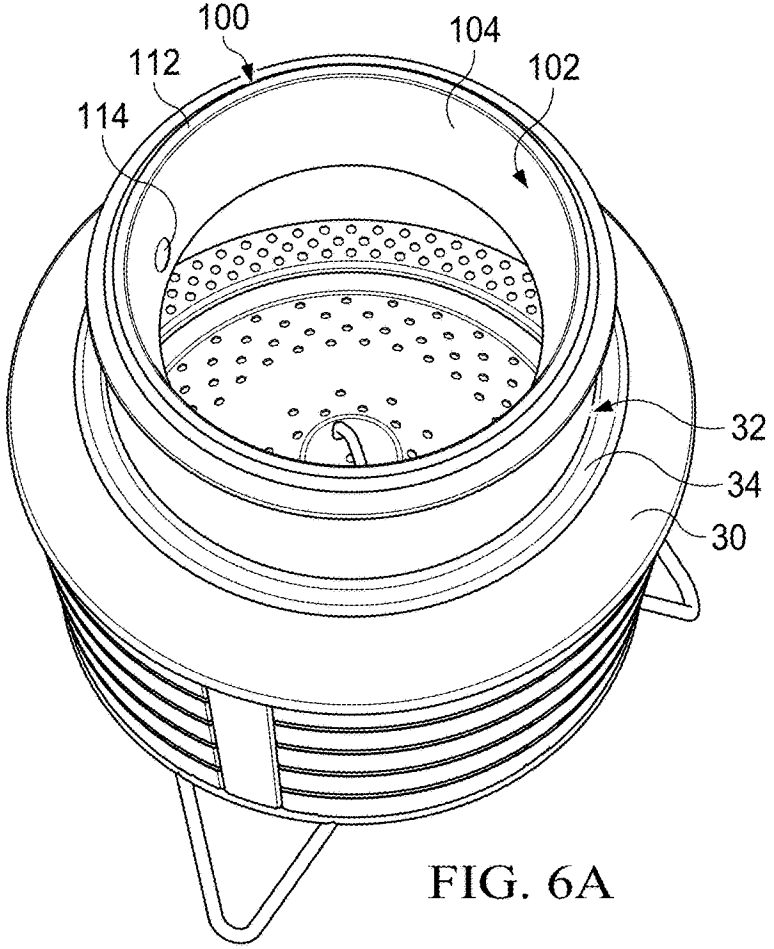
FIG. 6A is a photographic perspective view of the deflector located in the fire pit of FIG. 1 with the upper screen removed.
Figure 6D:
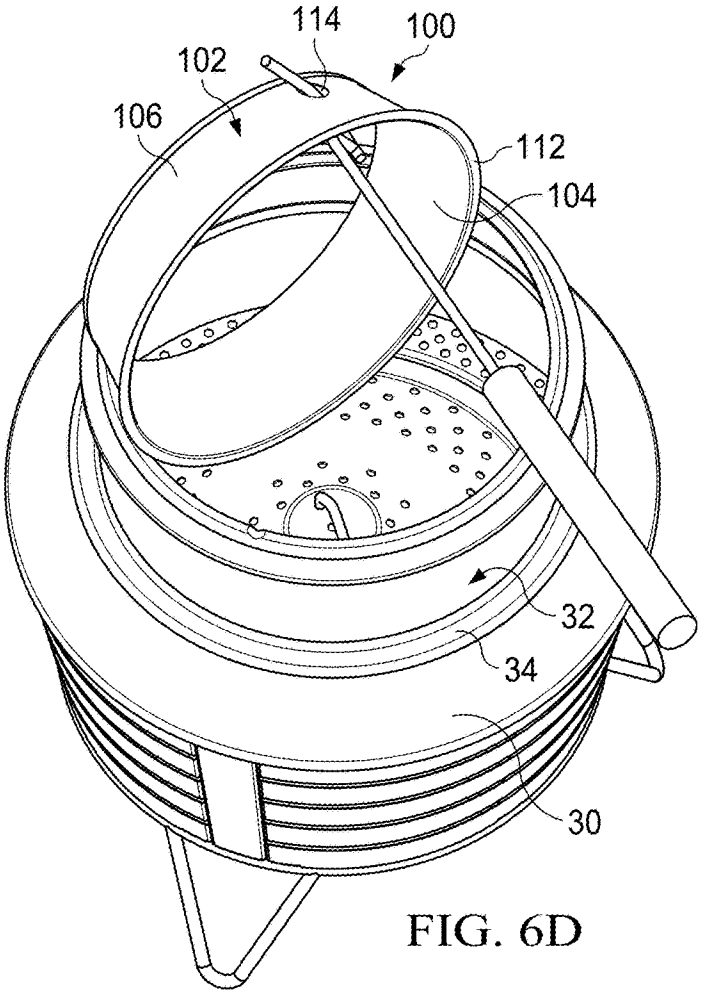
FIG. 6D is a photographic perspective view of the deflector located in the fire pit of FIG. 6A with the upper screen removed and showing an implement inserted into a through hole wherein the deflector is lifted up and out of the lower screen.
Figure 6C:
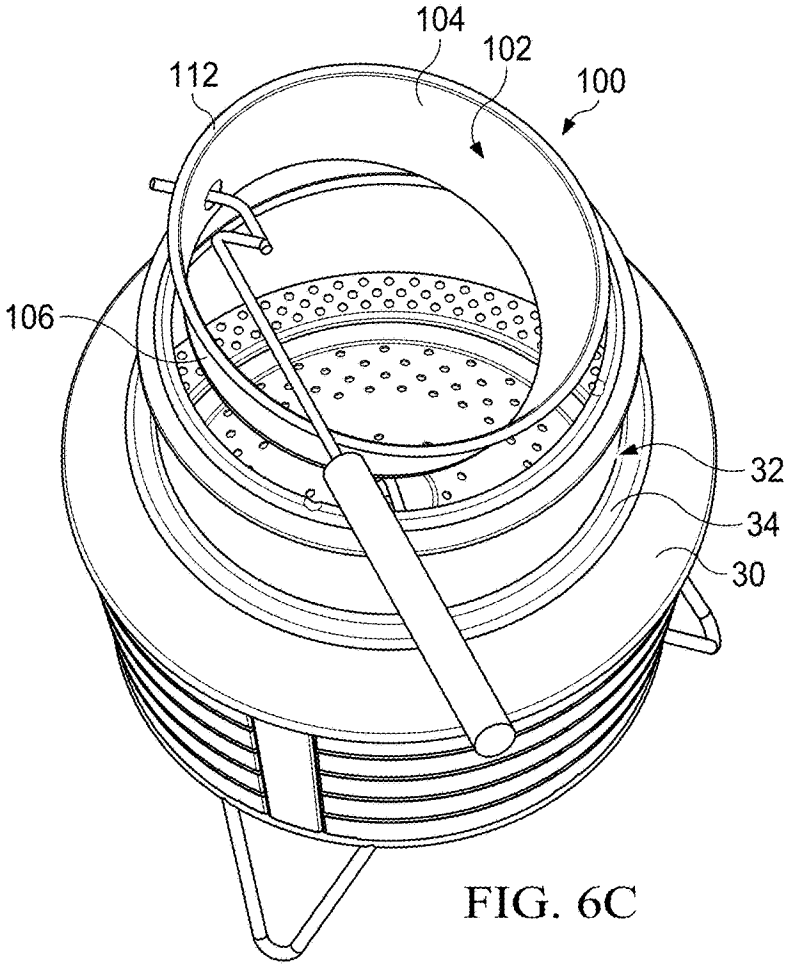
FIG. 6C is a photographic perspective view of the deflector located in the fire pit of FIG. 6A with the upper screen removed and showing an implement inserted into a through hole wherein the deflector is lifted up and out of the lower screen.
Figure 6E:
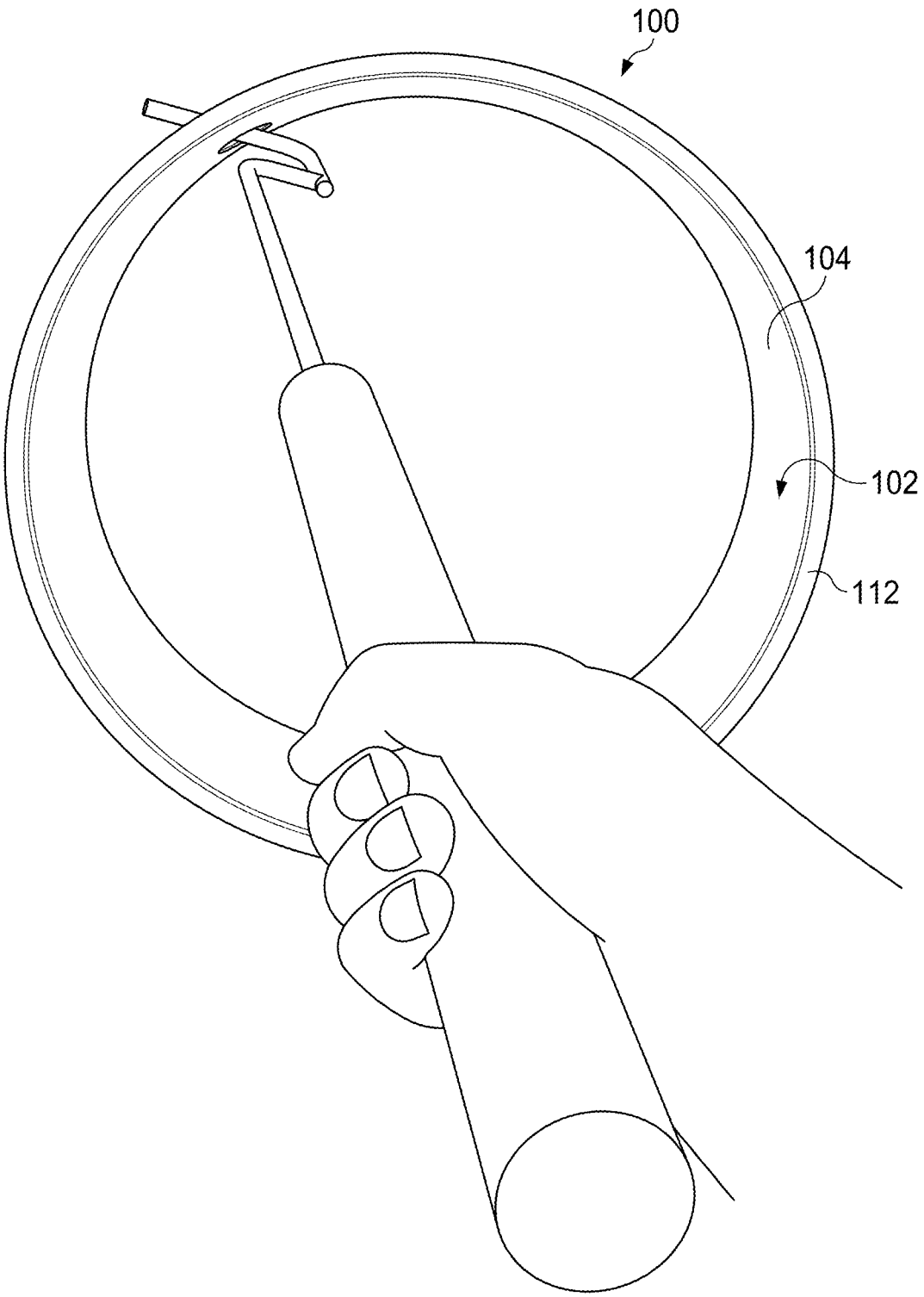
FIG. 6E is a photographic perspective view of the deflector removed from the fire pit of FIG. 6A with an implement inserted into a through hole and placed on the ground.
Figure 7B:
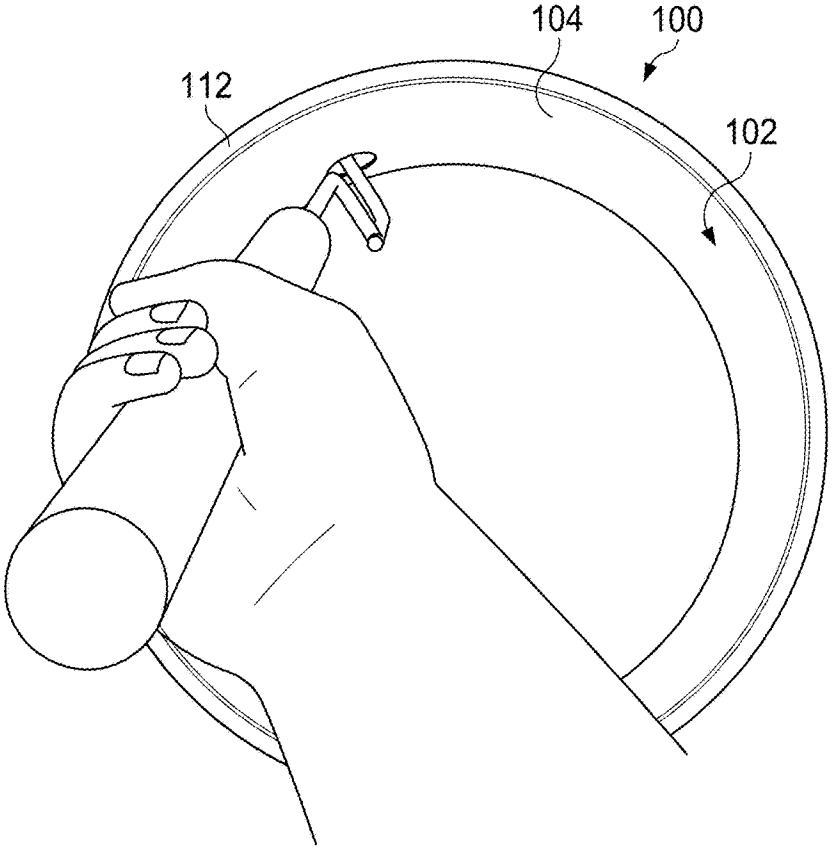
FIG. 7B is a photographic perspective view of the deflector removed from the fire pit of FIG. 6A wherein an implement is inserted into a through hole.
Figure 7A:
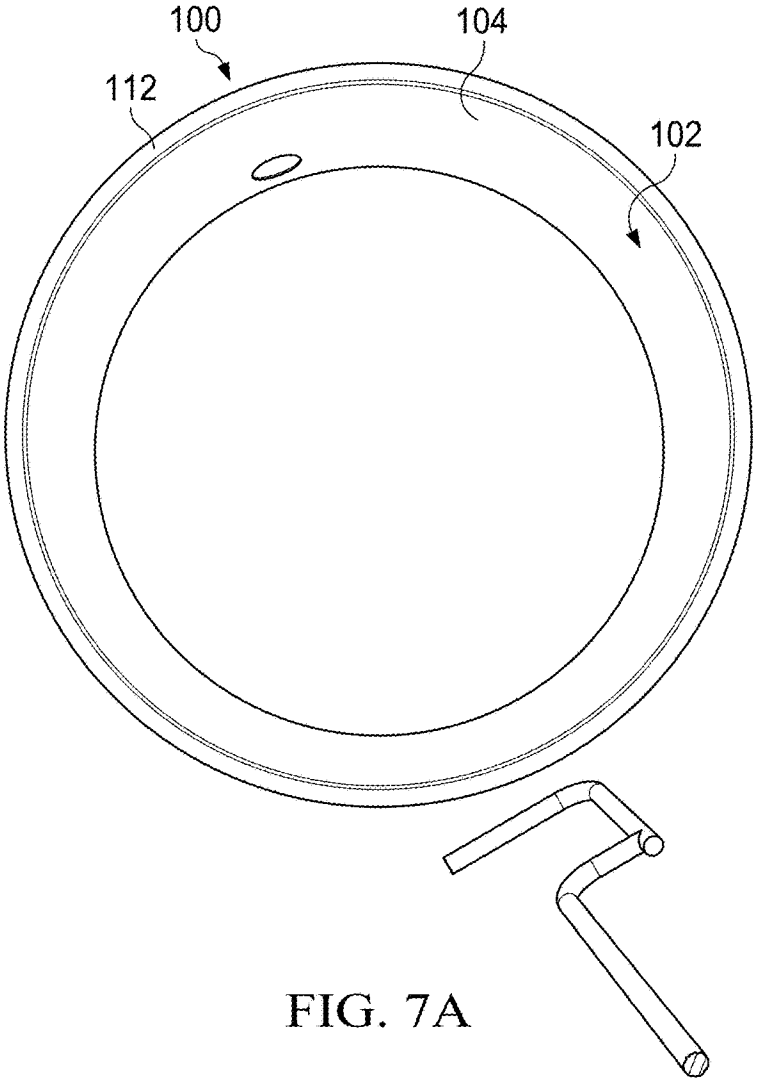
FIG. 7A is a photographic perspective view of the deflector removed from the fire pit of FIG. 6A.
Figure 7D:
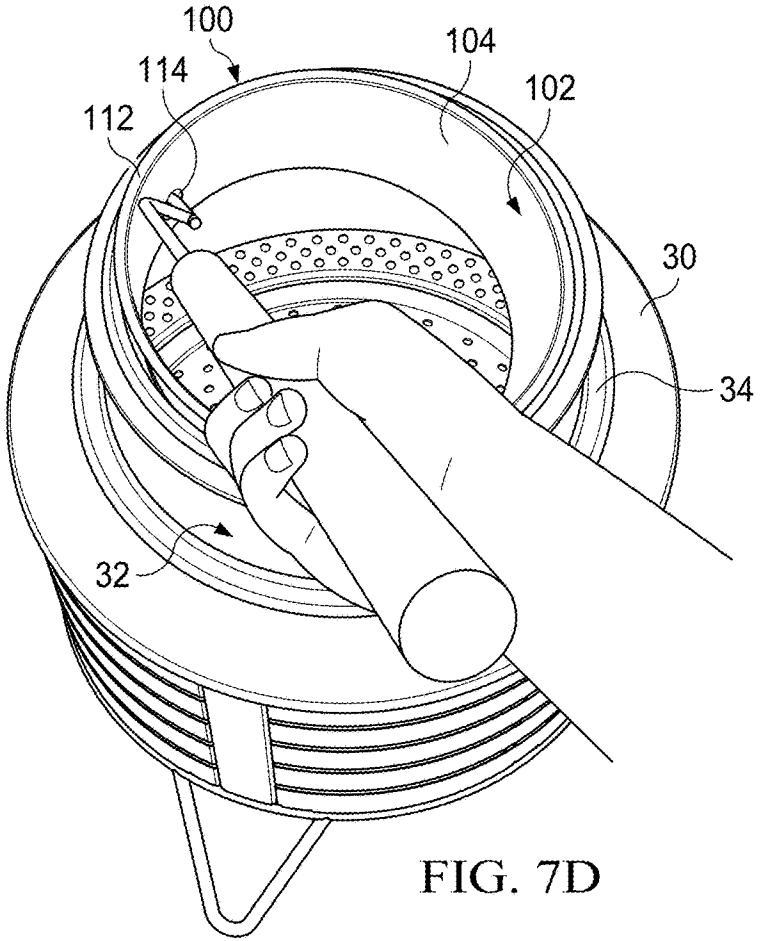
FIG. 7D is a photographic perspective view of the deflector is placed in the lower screen of the fire pit of FIG. 6A with an implement inserted into a through hole.
Figure 7C:
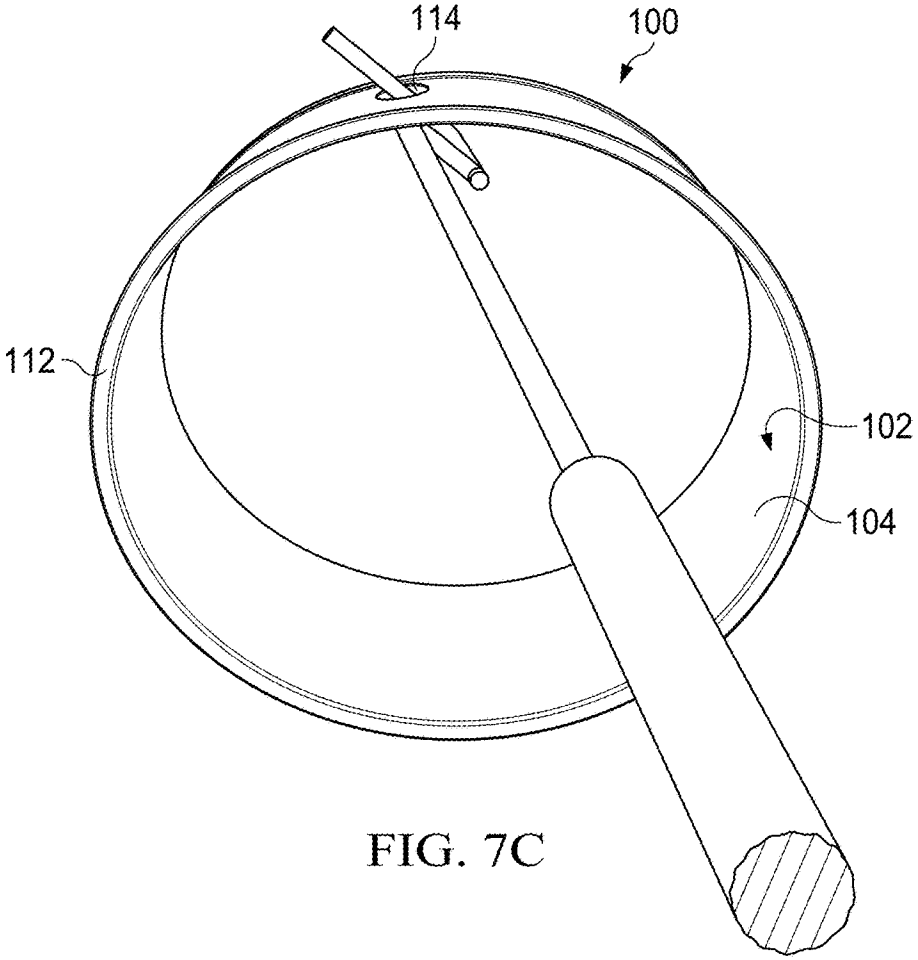
FIG. 7C is a photographic perspective view of the deflector removed from the fire pit of FIG. 6A wherein an implement is inserted into a through hole and lifted to facilitate installation of the deflector.
Figure 7E:
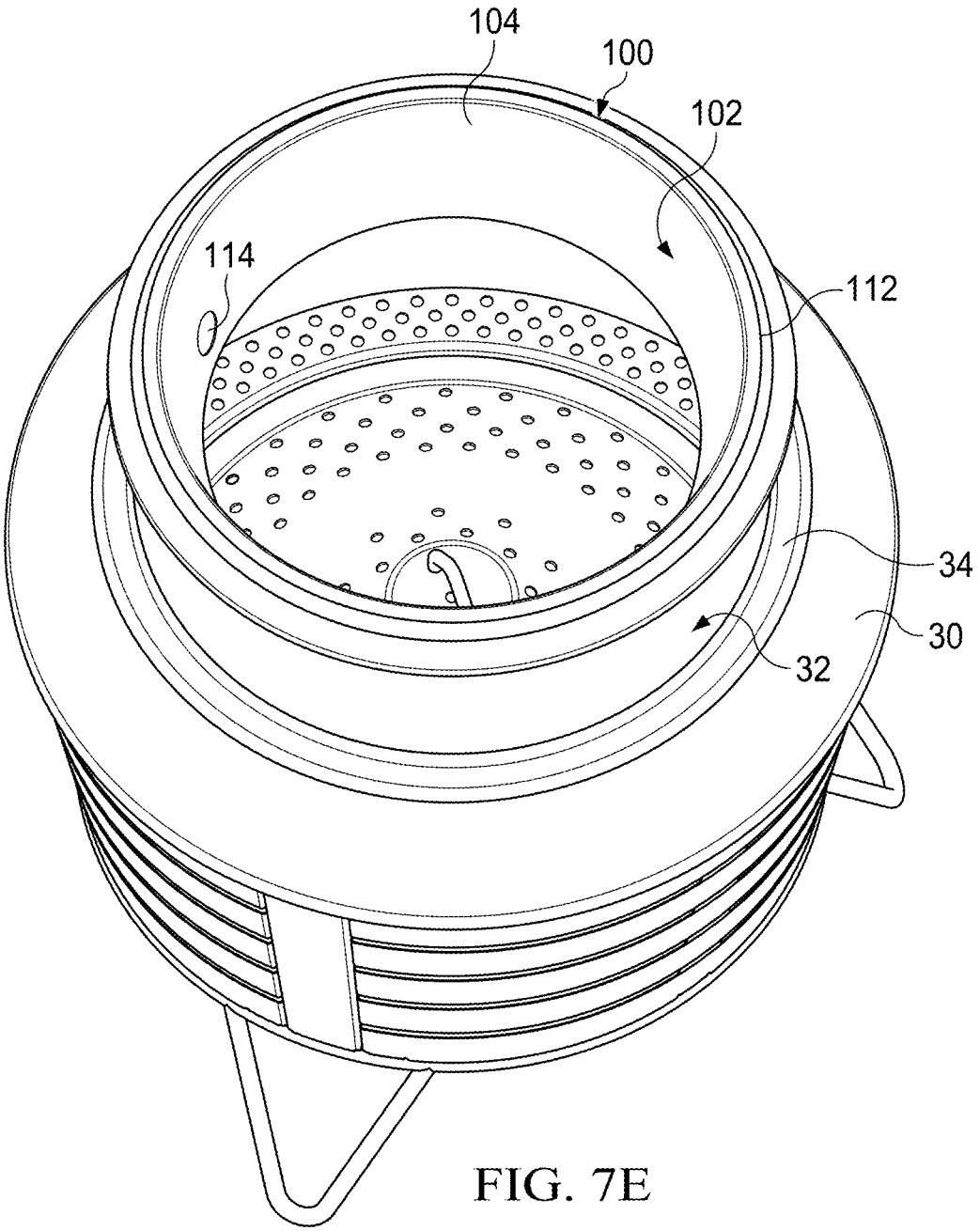
FIG. 7E is a photographic perspective view of the deflector re-installed in the fire pit of FIG. 6A with the implement removed from the through hole.

Lower screen 70 has a wall section 72 having a top screen surface and a bottom screen surface. The bottom screen surface engages lower screen ring 78. Lower screen ring 78 is sized for being matingly received on support ring 34 of top surface 30 of fire pit body 20. Top screen surface 30 engages upper screen ring 80. Upper screen ring 80 defines outer annular step 82 and inner upper support surface 84 (best seen in FIG. 4).

Upper screen 90 has an upper screen surface and a lower screen surface. The upper screen surface supports handle 96. The lower screen surface engages uppermost ring 98. Uppermost ring 98 is sized for being received on outer annular step 82 of upper screen ring 80 of lower screen 70 (see, e.g., FIG. 4).

Deflector 100 has a frustum shape. Deflector 100 defines wall portion 102 having an inner surface 104 and an outer surface 106. Wall portion 102 defines an upper end and a lower end. The upper end defines an outwardly extending lip 112. Lip 112 is sized for being received on inner upper support surface 84 of upper screen ring 80 of lower screen 70. Lip 112 allows for deflector 100 to be deployed inside lower screen 70. Lip 112 is sized such that upper screen 90 can also be installed. Wall portion 102 preferably defines through hole 114 for facilitating installation and removal of deflector 100 with an implement such as a poker. Through hole 114 is sized to allow insertion of an implement so that a user can install or remove deflector 100 without touching it.

Figure 2A:
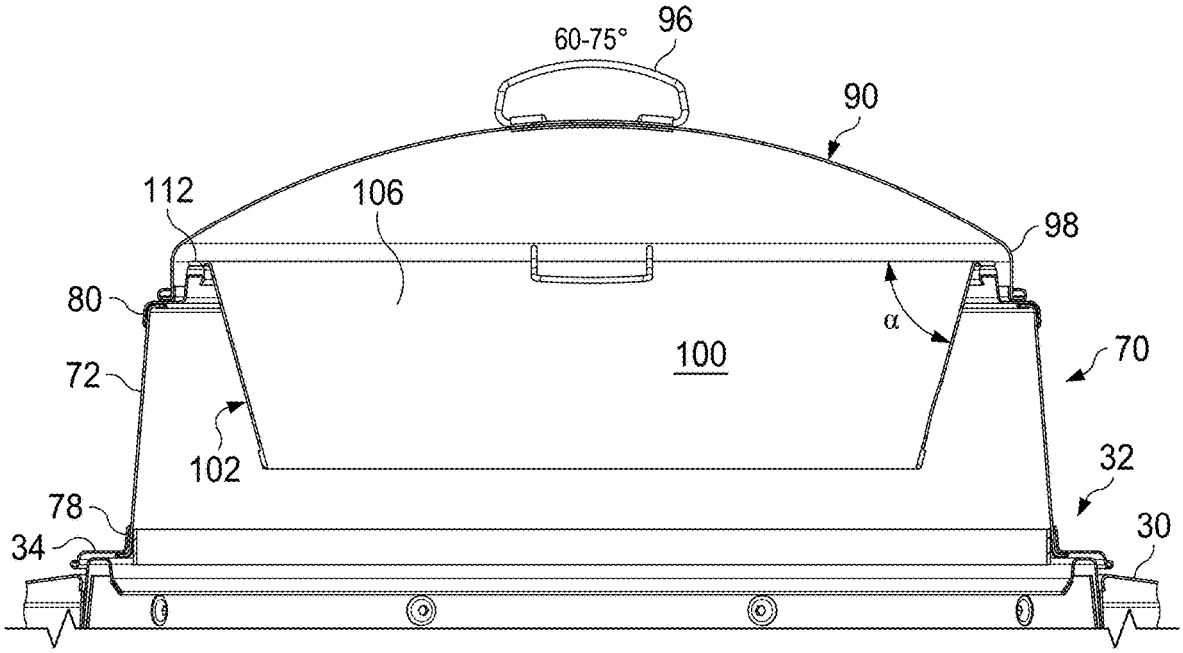
FIG. 2A is an elevation view of the upper screen, lower screen, and the deflector of the fire pit of FIG. 1.
Figure 2B:
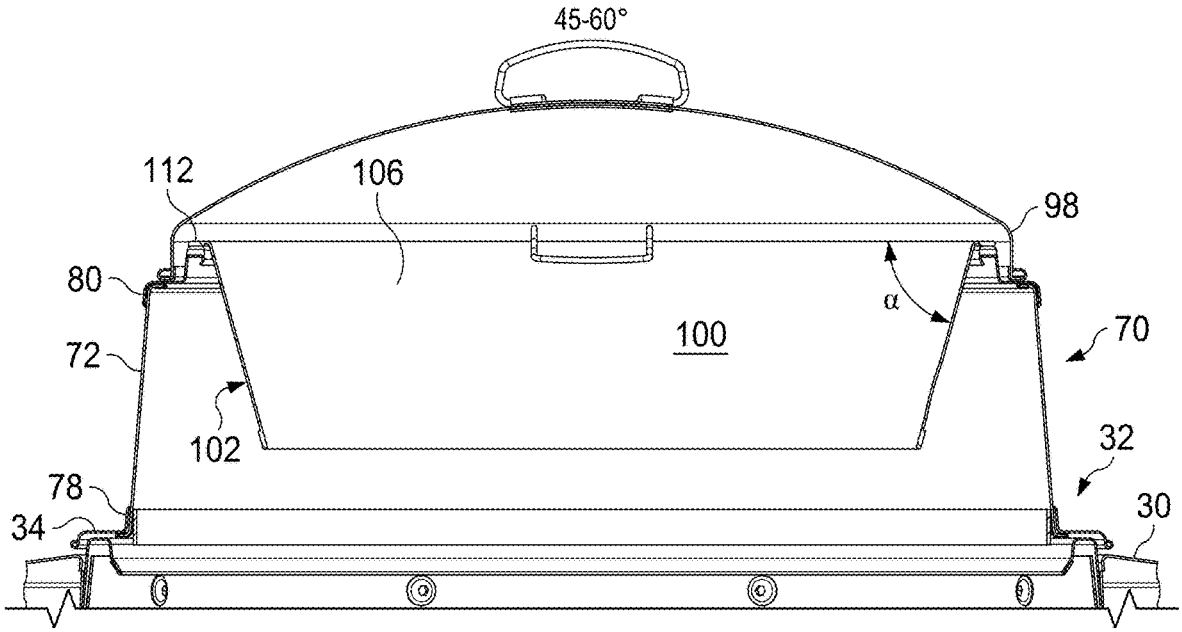
FIG. 2B is an elevation view of the upper screen, the lower screen and the deflector of the fire pit of FIG. 1.
Figure 3:
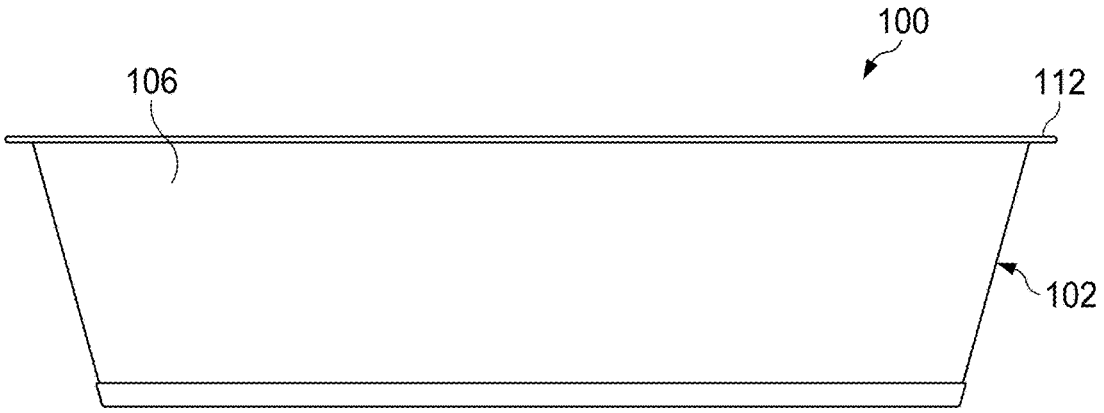
FIG. 3 is an elevation view of the deflector of the fire pit of FIG. 1.

In one embodiment, deflector 100 may have a height from upper end to lower end of between 50 mm to 150 mm, e.g., 90 mm to 115 mm. In one embodiment, the lower end is smaller than the upper end such that wall portion 102 is offset from vertical to have an outward lean, e.g. having an angle $\alpha$ from 45 degrees to 75 degrees (see, e.g., FIGS. 2A and 2B), more particularly having an angle $\alpha$ of 73.6 to 74.8 degrees from horizontal or having an angle $\alpha$ of approximately 74.5 degrees from horizontal. An angle $\alpha$ of 45 degrees to 75 degrees are most effective when considering the following factors: heat deflected to feet; heat deflected to body; heat deflected to head; smoke production, flame obstruction. Less effective angles result in poor performance such as minimal heat deflect to feet, body and head. Smaller angles of lean may result in a smaller central hole that creates more smoke, obstructs the flame more, and could result in a flame "mushroom" effect.

Outer surface 106 of deflector 100 is provided at an angle offset from vertical to radiate heat onto a user's body and feet. Inner surface 104 of deflector 100 is provided at an angle offset from vertical to radiate heat onto a user's body and head.

Figure 8:
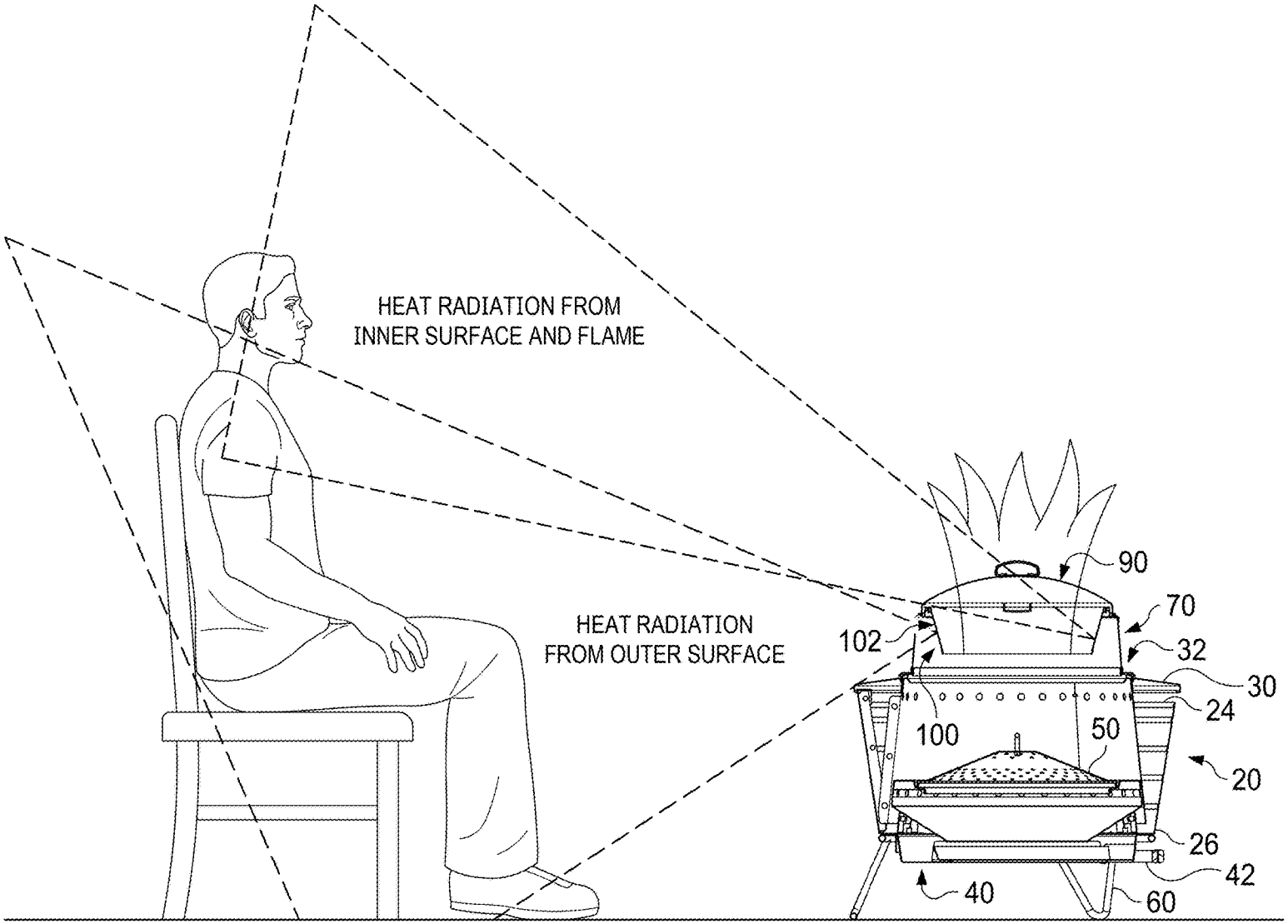
FIG. 8 is an elevation view of the fire pit of FIG. 1 showing heat radiated from the outer surface and from the inner surface of the deflector.

Referring now to FIG. 8, in use angled wall portion 102 of deflector 100 redirects heat flowing upwardly from fire pit receptacle opening 32 and deflects the heat outwardly. In particular, outer surface 106 deflects heat outwardly to a user's feet and body. Inner surface 104 deflects heat outwardly to a user's head and body.

In one embodiment, fire pit body 20, lower screen 70, and deflector 100 have a circular cross-section. Example circular components can be seen in FIGS. 1-8.

Figure 9:
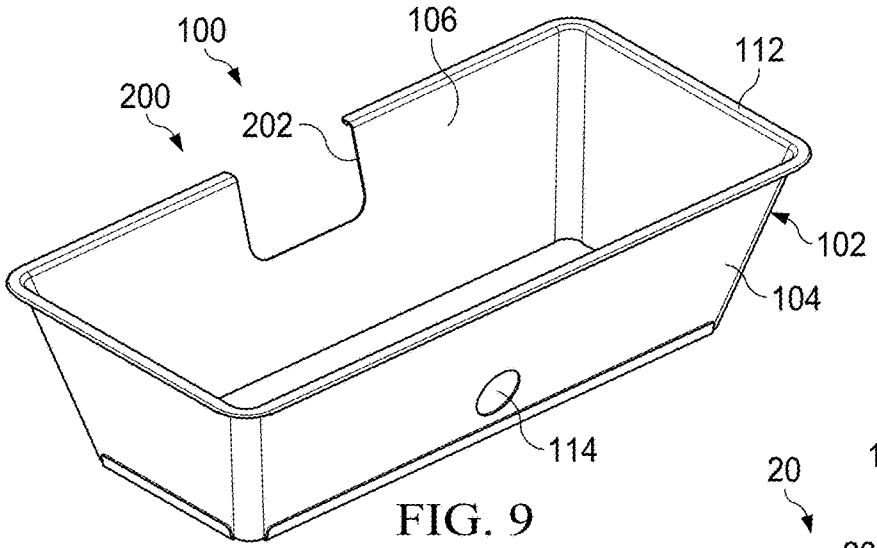
FIG. 9 is a perspective view of a rectangular embodiment of the deflector.
Figure 10:
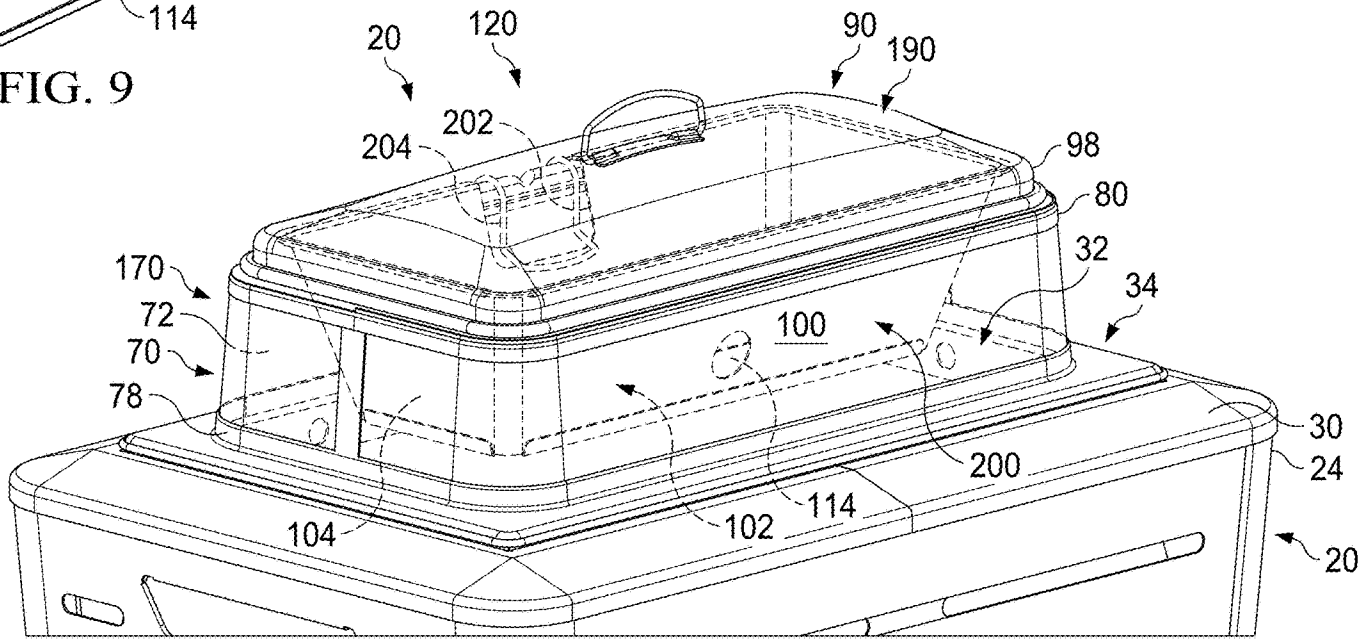
FIG. 10 is a perspective view of the rectangular embodiment of the deflector installed on a rectangular embodiment of a fire pit.

In another embodiment, fire pit body 20, lower screen 70, and deflector 100 have a rectangular cross-section. Example rectangular components can be seen in FIGS. 9-10. The rectangular embodiment of fire pit body 20 is designated rectangular fire pit body 120. The rectangular embodiment of lower screen 70 is designated, in particular, as rectangular lower screen 170. Rectangular embodiment of deflector 100 is designated particularly as rectangular deflector 200.

Rectangular deflector 200 defines cutout 202 in communication with the upper end. The rectangular embodiment of upper screen 90 is designated as rectangular upper screen 190. Rectangular upper screen 190 includes downwardly extending hook 204 for locating in cutout 202 (see, e.g., FIG. 10). Cutout 202 provides clearance for hook 204 on rectangular upper screen 190. Hook 204 allows for upper screen 190 to be hung off to the side of rectangular fire pit body 120, e.g., for stoking or refueling rectangular fire pit body 120.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fire pit comprising:

a pit body having a wall section, said wall section having an upper end and a lower end, said pit body having a top surface adjacent to said upper end of said wall section, said top surface defining a fire pit receptacle opening;

a lower screen above said top surface, said lower screen having a wall section with a top screen surface and a bottom screen surface;

an upper screen located above said lower screen, said upper screen having an upper screen surface and a lower screen surface; and a deflector received in said lower screen, said deflector having a frustum shape, said deflector defining a wall portion having an inner surface an outer surface, an upper end and a lower end, wherein said outer surface of said wall portion of said deflector is for radiating heat onto a user's body and feet, and wherein said inner surface of said wall portion of said deflector is for radiating heat onto a user's body and head;

wherein said pit body, said lower screen, said upper screen, and said deflector have a rectangular cross-section; and wherein said upper end of said deflector having a rectangular cross-section defines a cut-out; and wherein said upper screen having a rectangular cross-section includes a downwardly extending hook for locating in said cut-out, said hook for allowing said upper screen to be hung off to a side of said pit body having a rectangular cross section for stoking or for fueling said pit body having a rectangular cross section.

2. The fire pit according to claim 1 further comprising:

a support ring on said top surface surrounding said fire pit receptacle opening;

said bottom screen surface of said lower screen is received adjacent to said support ring on said top surface.

3. The fire pit according to claim 1 further comprising:

an upper screen ring supported by said top screen surface of said lower screen, wherein said upper screen ring defines an outer annular step and an inner upper support surface.

4. The fire pit according to claim 3 wherein:

said lower screen surface of said upper screen communicates with said upper screen ring, wherein said lower screen surface of said upper screen is sized for being received on said outer annular step of said upper screen ring.

5. The fire pit according to claim 3 wherein:

said upper end of said wall portion of said deflector defines an outwardly extending lip, said lip sized for being received on said inner support surface of said upper screen ring.

6. The fire pit according to claim 1 further comprising:

a handle on said upper screen surface of said upper screen.

7. The fire pit according to claim 1 wherein:

said wall portion of said deflector defines a through hole for facilitating installation and removal of said deflector with an implement without requiring a user to touch said deflector.

8. The fire pit according to claim 1 wherein:

a circumference of said lower end of said deflector is smaller than a circumference of said upper end such that said wall portion is offset from vertical to have an outward lean, wherein said wall portion of said deflector is 45 to 75 degrees from vertical.

9. The fire pit according to claim 8 wherein:

said wall portion of said deflector is 73.6 to 74.8 degrees from vertical.

10. The fire pit according to claim 9 wherein:

said wall portion of said deflector is approximately 74.5 degrees from vertical.

11. The fire pit according to claim 1 wherein:

said pit body, said lower screen and said deflector have a circular cross-section.

* * * * *